United States Patent [19]

Cho et al.

[11] 4,346,813

[45] Aug. 31, 1982

[54] CLOSURED AND DIVIDED BOX

[75] Inventors: Kazunobu Cho, Tokyo, Japan; Roger P. Beauchamp, Harrisville; Robert F. Batemou, Greenville, both of R.I.

[73] Assignee: Dart Industries Inc., Los Angeles, Calif.

[21] Appl. No.: 845,505

[22] Filed: Oct. 25, 1977

Related U.S. Application Data

[63] Continuation of Ser. No. 710,755, Aug. 2, 1976, abandoned.

[51] Int. Cl.[3] ..... B65D 25/04

[52] U.S. Cl. ..... 220/22; 220/20; 220/411

[58] Field of Search ..... 220/20, 22, 22.1, 22.2, 220/22.3, 17, 408, 410, 411, 412

[56] References Cited

U.S. PATENT DOCUMENTS

| | | | |
|---|---|---|---|
| 2,034,030 | 3/1936 | Gaugler | 220/22 |
| 2,123,359 | 7/1938 | Hallmark | 220/22 |
| 3,391,816 | 7/1968 | Swett | 220/17 |

*Primary Examiner*—George E. Lowrance
*Attorney, Agent, or Firm*—Leigh B. Taylor

[57] ABSTRACT

A container with outwardly bowed walls having a removable divider with positioning flanges at its ends which are adapted to mate with similarly shaped surfaces formed in the side walls of the container.

1 Claim, 6 Drawing Figures

CLOSURED AND DIVIDED BOX

This is a continuation of application Ser. No. 710,755, filed Aug. 2, 1976, now abandoned.

This invention relates to a container and more particularly to a container and lid structure. The container of this invention is capable of being compartmentalized so as to present container portions of fixed size.

Containers such as the type here under consideration are frequently utilized for the storage of foodstuff and related items wherein it is often desirable to store therein various type foods which are desirably kept separate from each other. Accordingly, the present invention presents a construction whereby a container is provided with a central divider member. Such a concept gives a greater amount of flexibility and utility to containers of the present type which accordingly may also be used as lunch boxes.

It is also desirable to provide an effective barrier between the varying size compartments of the present container so as to reduce the possible spillage therebetween and to further reduce the amount of possible odor transmittal from a material stored in one compartment to a material stored in the other. Thus, the present construction provides a divider which is in substantially full contact with the sidewalls and bottom of the container in the lateral plane of its positioning and is in close proximity with a cover member common to both of such container's compartments. Accordingly, an effective seal is provided between the two compartments of the present container.

It is therefore a primary object of the present invention to provide a container primarily for the storage of foodstuffs and the like whereby said container can be divided into variable sized compartments and wherein an effective separator is provided between such compartments of a relatively uncomplicated and simple structural nature which is capable of relatively low cost and high tolerance manufacture from plastic material such as by injection molding procedures.

A further object of the present invention is to provide a storage container for foodstuffs and the like whereby separate compartments are provided therein by means of a firmly positioned separator member having at either end thereof a flange configuration that stabilizes the separator or divider during all facets of container use even when the closure is removed therefrom.

Other objects of the present invention will become apparent in the course of the following specification wherein the invention will appear more clearly from the following detailed description taken in conjunction with the accompanying drawings showing, by way of example, a preferred embodiment of the inventor's concept.

IN THE DRAWINGS

Throughout the specification, like reference numerals are used to indicate like parts.

Figure 1:
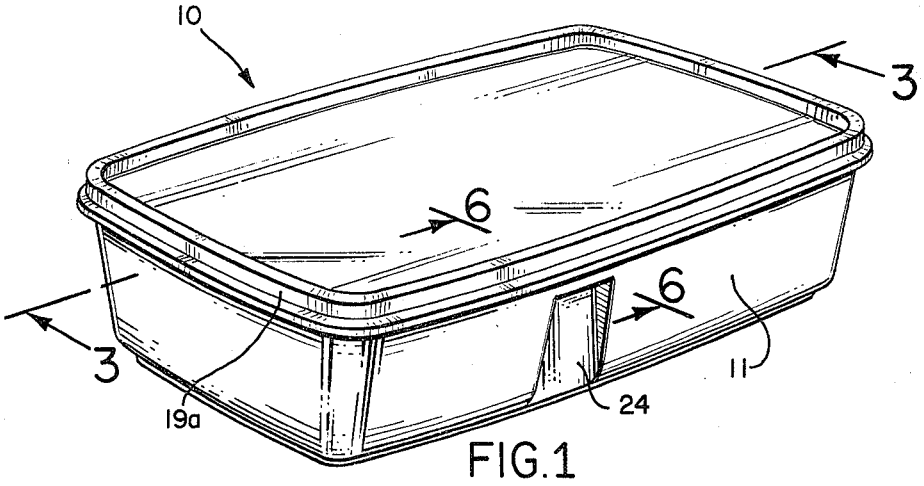
FIG. 1 is a perspective view of the storage container of the present invention.
Figure 2:
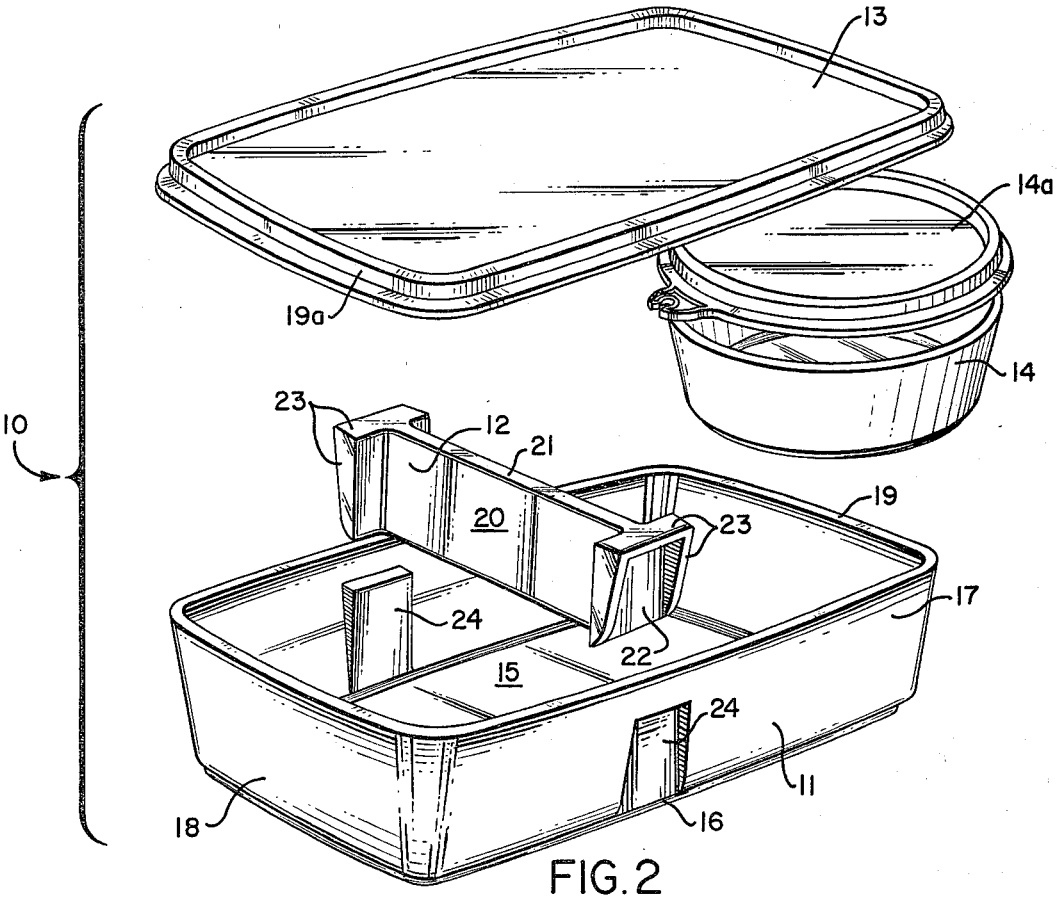
FIG. 2 is a perspective view of the storage container of the present invention with the cover portion thereof removed and wherein a subsidiary container is shown in relation thereto.
Figure 3:
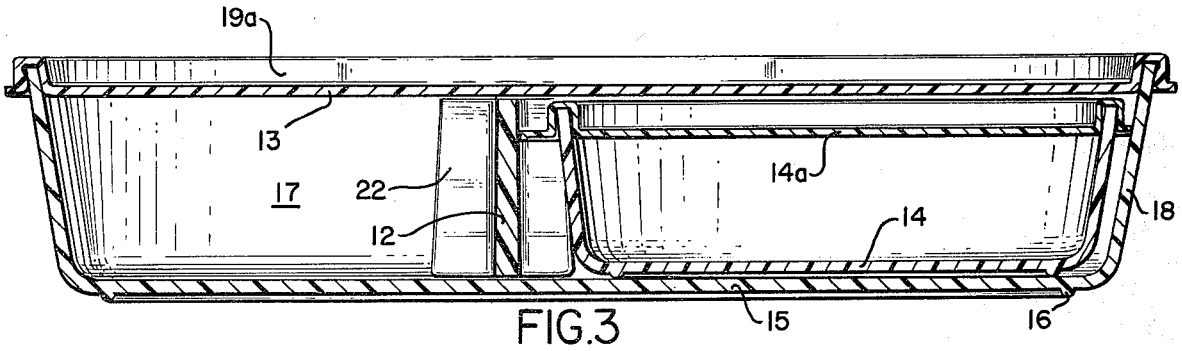
FIG. 3 is a sectional view along the line 3—3 of FIG. 1.

Referring to the drawings, and more particularly to FIGS. 1 and 2 thereof, the container device 10 of the present invention comprises a container or base 11, divider member 12 and a cover or lid portion 13. One or more of subsidiary containers 14 may be further placed within the primary container 11 in a manner and through a constructional relationship which will be hereinafter more apparent. Likewise note that the subsidiary container 14 shown is also sized such that it may be independently closured by the seal member **14*a***.

The container, or base 11, is comprised of a generally rectangular bottom member 15 having a raised peripheral supporting bead 16. The container 11 is further provided with sidewalls 17 which are in opposed relationship to each other and of a relatively long extent in comparison to the endwalls 18 interspaced therebetween and which serve as interconnections therewith. Both the sidewalls 17 and the endwalls 18 are preferably upwardly and slightly outwardly disposed for ease in receipt of the slidable member 12 and the container lid 13 as will hereinafter be more apparent. The sidewalls 17 and the endwalls 18 upwardly terminate in a peripheral rim 19 which is sealingly engaged by a downwardly opening U-shaped peripheral rim **19*a* of the container lid 13. The sealing engagement is such that materials and particularly foodstuffs may be placed therein for essentially air tight storage. The seal 14*a* is similarly adapted for placement upon subsidiary container 14** and functions in like fashion thereto.

Figure 4:
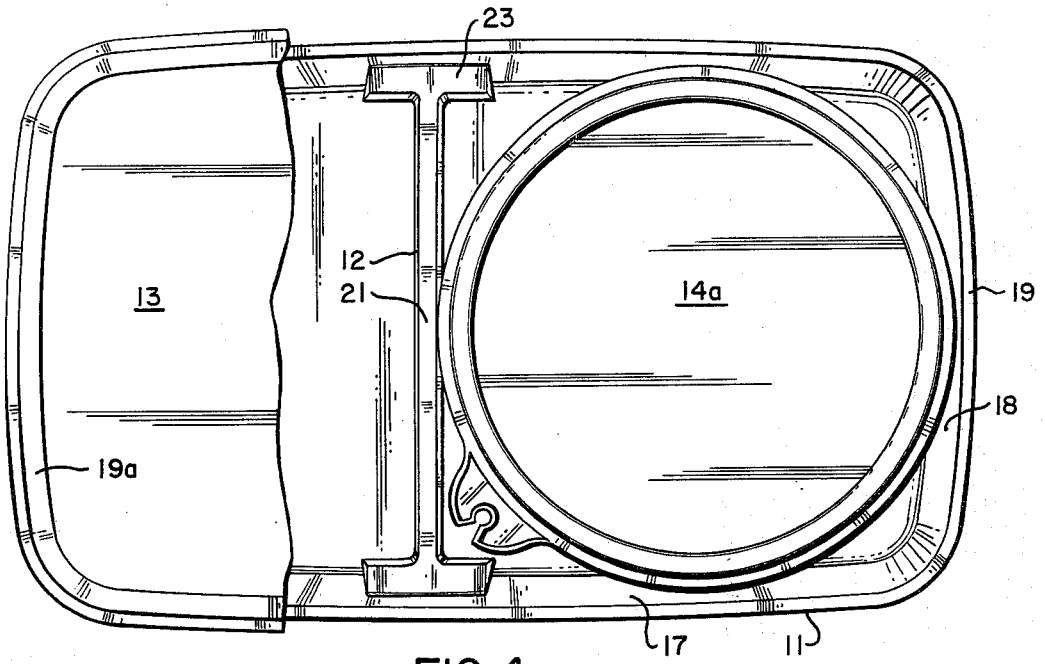
FIG. 4 is a plan view of the container shown in FIG. 1 of the drawings wherein the closure has been partially removed.

It should be noted that the sidewalls 17 are slightly outwardly bowed at their central position such as shown in particular by the FIG. 4 plan view of the drawings. Thus, the width between the sidewalls 17 is slightly greater at the central longitudinal location thereof than is such proximate the endwalls 18 of the container 11.

The divider member 12 is generally comprised of an upstanding central member or plate 20, which is imperforate and upwardly terminates along a generally straight top wall portion or edge 21. This top edge 21 of the plate 20 is adapted to be in close proximity to the underside of the lid 13 when such member 12 is placed between the sidewalls 17 in a manner as particularly shown in FIG. 2 of the drawings. Thus with such construction the container 11 is substantially divided into two separate compartments in which foodstuffs of differing consistency or material may be stored in segregated position within a common container and lid sealing structure.

The member 12 and in particular plate 20 is provided at each end with flanges 22 each extending normally outwardly from either side of the plate member 20.

Figure 5:
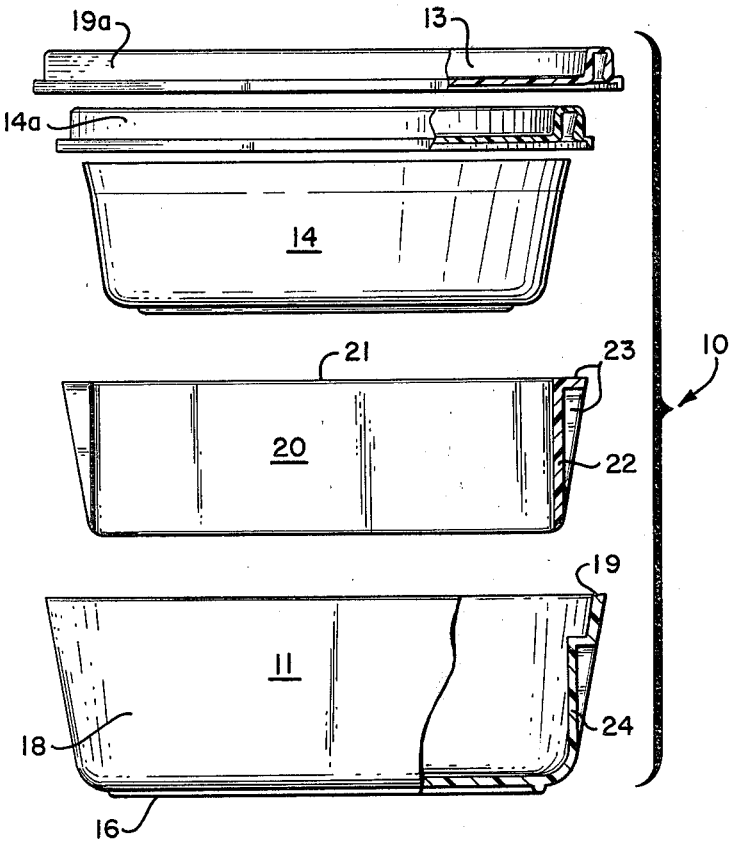
FIG. 5 is a partial sectional view of the storage container taken along the line 5—5 in FIG. 2.
Figure 6:
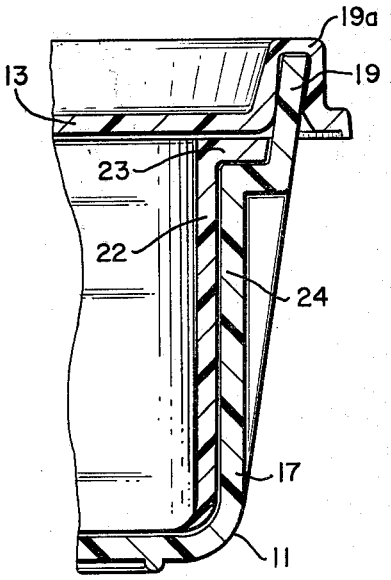
FIG. 6 is an enlarged partial elevational view of the divider member positioned within the container.

The flanges 22 as can best be seen in FIGS. 2, 5 and 6 are bounded along their vertical and upper edge extent by walls 23 that protrude outwardly therefrom. This end construction of the separator is adapted to mate with, over and around the inwardly directed protrusions 24 that are formed as an integral part of container sidewalls 11.

This mating engagement firmly affixes the divider 12 within the container due to the lateral extent of the protrusions 24 which preferably approximate 50% of the container sidewall height or depth. It should however be appreciated that such may be reduced or increased depending upon the materials of construction of the elements and the size of the container among other things. Furthermore, the surrounding wall structure 23 minimizes the accessibility of stored product to find its way into areas of contact between flanges 22 and protrusions 24. Likewise, the horizontally extending portion thereof provides for the uniform continuity of the upper extent or edge 21 of the plate 20. This further assures for retention of the edge 21 in close proximity to the closure 13 and will minimize the transference of product between compartments.

Suitable materials for the divider member 12 would be high density polyethylene, polypropylene or similar copolymeric materials. The container 11 is preferably formed of the same materials but may also be of a low or medium density polyethylene which is slightly more flexible than the material from which the slidable member is made and also exhibits the characteristic of being slightly locally distortable.

Turning now to FIG. 4 of the drawings, an additional feature of the invention is shown wherein a smaller subsidiary container 14 may be placed within the parent container 11 beside the member 12. This closured subsidiary container, of course, can function to completely segregate containerized products in the event such is desired. Similarly, it should be evident that the size and shape of such subsidiary container 14 is dependent upon the choice of the manufacturer.

It is believed, therefore, that the present invention provides a storage container which has increased utility inasmuch as such may be divided into subsidiary compartments of varying size in a simple and easily constructed manner as hereinbefore set forth. While there is above disclosed a preferred embodiment of the present storage container, it is possible to produce other embodiments without departing from the inventive concept herein disclosed and as set forth in the following claims.

I claim:

1. A sealable storage container having an interconnecting side and bottom wall construction said side wall including inwardly directed oppositely positioned protrusions of a width of between about 25% and 60% of the height of said side wall and which extend between points proximate said bottom wall and the upper edge of said side wall, said protrusions gradually increasing in depth toward their upper extents to create a wedge-like appearance inwardly of said container and an upright imperforate divider member having an upright flange at either end thereof, each of said flanges being bounded along its vertical and upper extents by outwardly extending walls that mate with said protrusions and which at the lower extent thereof blend into said flange in a shape compatible with the interconnection between said side and bottom wall construction.

* * * * *